United States Patent [19]

Moe et al.

[11] 4,446,649

[45] May 8, 1984

[54] MOBILE BLOCKS

[76] Inventors: Walter Moe, 13039 Skyvalle Rd., Los Angeles, Calif. 90049; Charles M. Diker, c/o Diker Moe, 1 New York Plz., New York, N.Y. 10004

[21] Appl. No.: 311,937

[22] Filed: Oct. 16, 1981

[51] Int. Cl.[3] ..... A63H 7/02; A63H 7/00

[52] U.S. Cl. ..... 46/218; 46/201; 46/25

[58] Field of Search ..... 46/201, 202, 216, 217, 46/218, 16, 17, 25, 26

[56] References Cited

U.S. PATENT DOCUMENTS 875,519 12/1907 Haberlin ..... 46/218 X 1,931,139 10/1933 Warren ..... 46/201

*Primary Examiner*—Robert A. Hafer

*Assistant Examiner*—Perry Knutson

*Attorney, Agent, or Firm*—Maky, Renner, Otto & Boisselle

[57] ABSTRACT

A unique block construction for forming toy blocks which can be either interconnected to form a train, or stacked on top of each other. A block according to the invention includes a coupling which has a retracted position in which it forms part of the basic block contour when the block is to be stacked, and which can be manipulated into a protracted position for coupling the block to another block to form a train.

10 Claims, 6 Drawing Figures

MOBILE BLOCKS

BACKGROUND AND SUMMARY OF THE INVENTION

This application relates to a unique block construction for forming toy blocks which can be either interconnected to form a train, or stacked on top of each other. A block according to the invention includes a coupling which has a retracted position in which it forms part of the basic block contour when the block is to be stacked, and which can be manipulated into a protracted position for coupling the block to another block to form a train.

According to the invention, the block has a bottom portion with wheels which roll in order to move the block. The block has a top portion which can support the bottom portion of another block of similar construction and minimize relative lateral shifting of the blocks, to allow stacking of the blocks. The block has a coupling member which can move between a retracted position and a protracted position. When it is in a retracted position, the coupling member forms a part of the basic contour of the block, so that the block has a true block contour when it is to be stacked. When the coupling member is in a protracted position, it projects partly from the block for coupling the block with another block to form a train.

Preferably, the coupling member is slidable in a slot formed in the block. When the coupling member is in its retracted position, it is disposed completely in the slot. When the coupling member is moved to its protracted position, it projects out of one part of the slot and creates a recess in another part of the slot. The slot has notches adjacent its ends, and the coupling member carries locking tabs which can engage the notches. Thus, when a coupling member projecting from one block slides into a recess formed in another block, the locking tab on the projecting coupling member engages the notch in the recess, thereby coupling the blocks together to form a train.

The top side of the block can engage the bottom side of another block of similar construction and minimize relative lateral movement between the blocks, to thereby allow stacking of the blocks. The top side of the block has arcuate recesses for receiving the wheels on the bottom side of another block in a way which resists rolling movement of the wheels. The top side of the block is also designed to block sideways shifting of the wheels. Thus, a pair of blocks can be stacked in such a manner that the blocks cannot roll, or shift sideways relative to one another.

Significantly, the configuration of the coupling member and the slot allows the block to have a true block contour (i.e., no protruding parts) when it is stacked on another block. The ends of the coupling member have flat surfaces which, when the coupling member is disposed completely in the slot, are generally aligned with the side walls of the block, and form part of the basic contour of the block.

DESCRIPTION OF THE DRAWINGS

The further objects and advantages of the invention will become further appararent from the following detailed description taken with reference to the accompanying drawings wherein.

DETAILED DESCRIPTION OF THE PREFERRED EMBODIMENT

Figure 1:
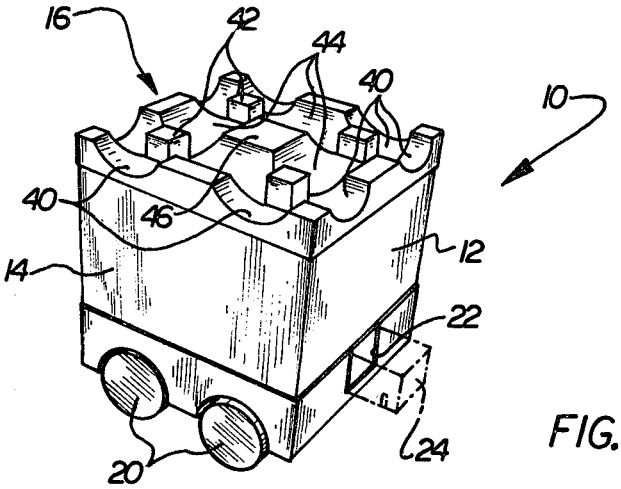
FIG. 1 is a three dimensional view of a block constructed according to the principles of the invention, showing in full line the position of a coupling member disposed completely in its respective slot, and showing in phantom lines the position of a coupling member projecting from its respective slot.

As discussed above, this invention relates to blocks which can be interconnected to form a train, and which can also be used to form a stack of blocks. FIG. 1 shows the general configuration of a block 10 constructed according to the invention. The block 10 is preferably formed of plastic, and has a generally cube shaped body 11 including a top portion 16, a bottom portion 18, and two pairs of parallel side walls 12 and 14 extending between the top and bottom portions.

A set of wheels 20 is connected with the bottom portion 16. The wheels 20 are aligned with (i.e., generally parallel to) the side walls 14, and can roll in order to move the block 10 in directions normal to the side walls 12. As shown by FIG. 1, a pair of wheels 20 is aligned with one side wall 14, and each wheel of the pair is connected (through a common axle) with a respective wheel which is aligned with the other side wall 14.

Figure 2:
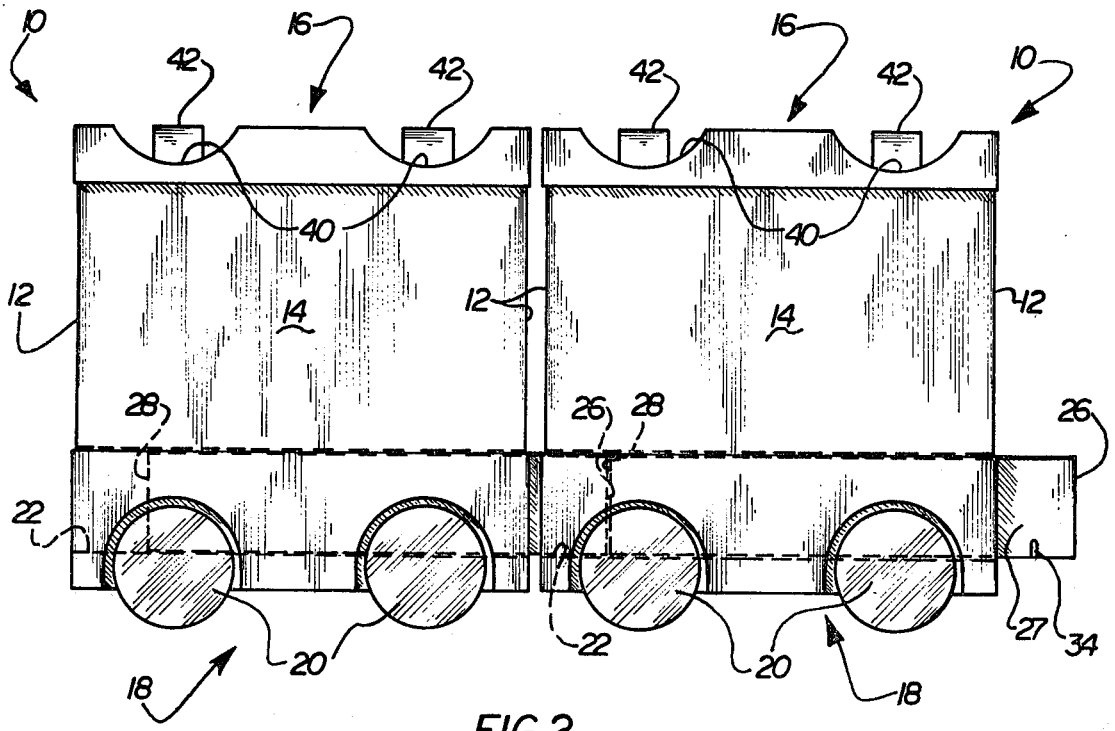
FIG. 2 is a side elevational view of a pair of blocks according to the invention in a joined-together condition and forming a train.
Figure 4:
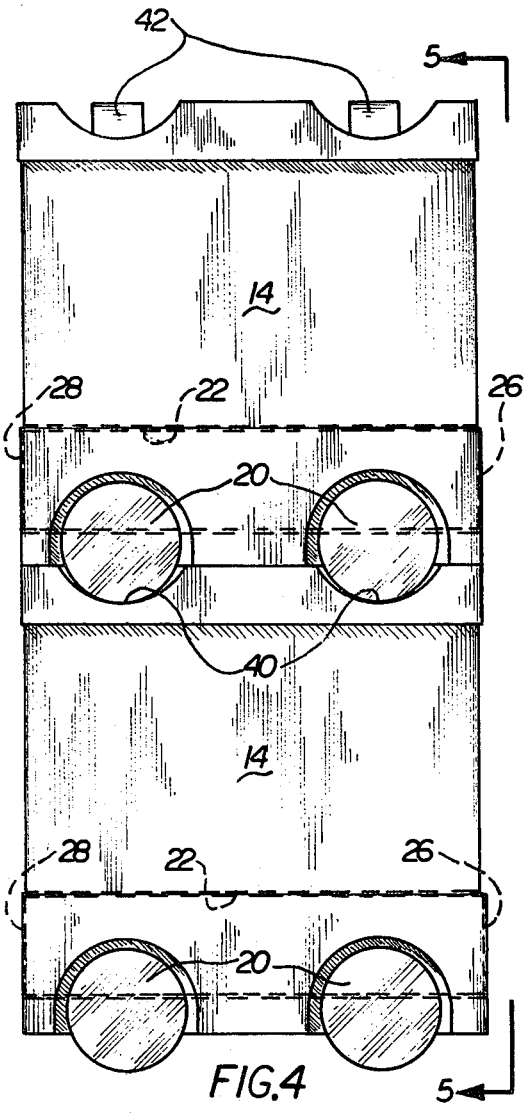
FIG. 4 is a side elevational view of a pair of blocks according to the invention in a stacked condition.
Figure 5:
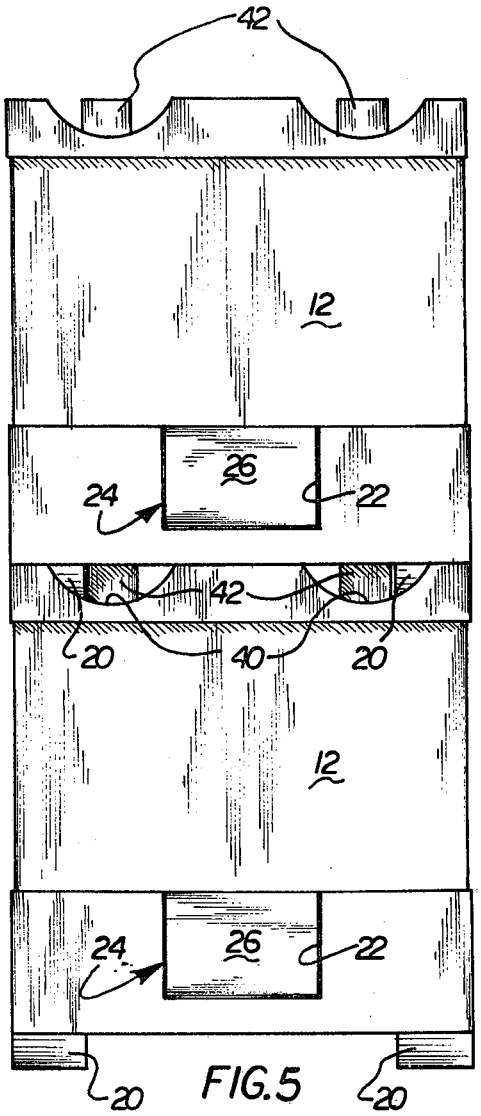
FIG. 5 is a side elevational view of the blocks of FIG. 4, taken from the direction 5—5.

In accordance with the invention, a block 10 includes coupling structure designed so that two or more of such blocks can be coupled together to form a train, as shown in FIG. 2. Further, the top portion 16 of the block is designed to support another block of similar construction and to minimize relative lateral (i.e., horizontal) shifting of the blocks, so that one block may be stacked on top of another block in the manner shown generally in FIGS. 4 and 5.

The block includes a slot 22 which extends completely through the body 11 (from one side wall 12 to the opposite parallel side wall 12). A coupling member 24 is slidably supported in the slot 22. Thus, viewing the blocks shown in FIGS. 2 and 4, the slot 22 extends completely through the body of the block and intersects both of the side walls 12. The coupling member 24 is disposed in the slot 22 and can slide in the slot 22. The coupling member 24 has a top wall 25, side walls 27, and parallel end walls 26, 28. The length of the coupling member 24 is equal to the length of the slot 22 so that when the coupling member is completely disposed in the slot 22, end walls 26, 28 are aligned with the side walls 12. When the coupling member 24 is disposed completely in the recess 22, it is in what may be termed a retracted position, and its end walls 26, 28 form part of the basic (i.e., cubical) block contour.

The coupling member 24 can be slid (protracted) out of either side of the slot 22 to form a projection extending outwardly from one side wall 12, and creating a recess extending inwardly from the other side wall 12.

FIG. 1 shows, in phantom lines, the coupling member protruding outwardly from one of the side walls 12. At the other side wall 12 a recess 30 (shown in FIG. 6) is created.

Figure 6:
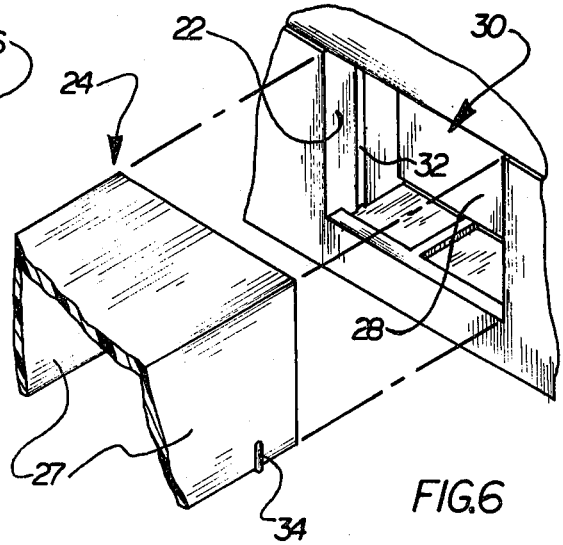
FIG. 6 is a fragmentary three-dimensional view showing the mechanism for coupling a pair of blocks according to the invention.

The slot 22 includes notches 32 disposed adjacent the side walls 12 (FIG. 6 shows one of those notches). When a coupling member 34 is disposed completely within the slot 22, it covers the notches 32 adjacent both ends of the slot. When a coupling member 24 is slid out of one part of the slot 22 and creates a recess in the other part of the slot, it uncovers the notch 32 adjacent that other part of the slot. The coupling member has locking tabs 34 on its side walls 27 adjacent both of its ends. When a coupling member which projects from one block is inserted into the recess formed in another block, the locking tabs 34 on the projecting coupling member engage the notches 32 formed in the recess, thereby coupling the blocks together to form a train as shown in FIG. 2. The engagement of the locking tabs 34 with the notches 32 is secure enough so that the blocks stay coupled together as the train moves, and is also designed so that the blocks can be readily separated without excessive force. As seen from FIG. 6, the coupling member is preferably open at the bottom, thereby allowing the side walls 27 carrying the locking tabs to flex as the blocks are uncoupled. The slots 22 have stops (not shown) which resist excess movement of the coupling member in either direction, in order to avoid the coupling member from being slid completely out of the slot 22.

Figure 3:
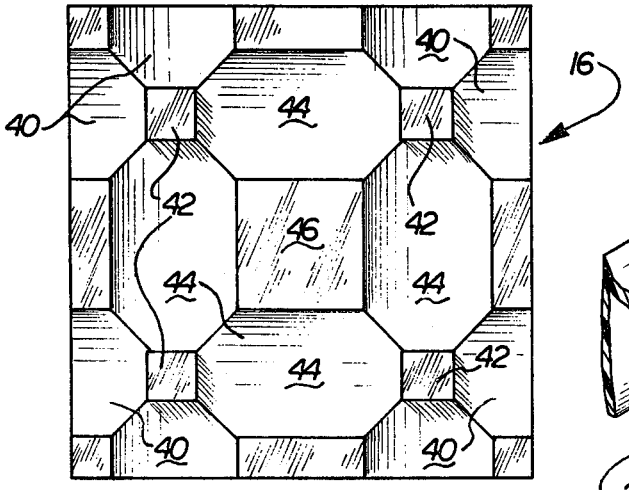
FIG. 3 is a top plan view of a block according to the invention.

As discussed above, the blocks are also designed so as to be stacked. Referring to FIGS. 1 and 3, the top portion 16 of the block includes arcuate recesses 40 aligned with the side walls 12, 14. The arcuate recesses 40 are dimensioned so as to be spaced apart by about the length of the wheel spacing. Further, the top portion of the block 10 includes a series of upstanding stop members 42 which extend above the arcuate recesses 40. As seen in the Figures, the stop members 42 are disposed near the corners of the block, with each stop member 42 facing both of the arcuate recesses 40 which are adjacent that corner of the block.

In order to stack the blocks 10, the bottom portion of one block is placed on top of another block, with the wheels 20 of the top block disposed in respective arcuate recesses 40 in the bottom block. The wheels 20 can be disposed in the arcuate recesses which are aligned with either the side walls 12 or the side walls 14. In either orientation the stop members 42 face the wheels, and resist relative sideways shifting of the blocks. Further, the arcuate recesses 40 minimize the likelihood of relative shifting of the blocks due to rolling of the wheels. Thus, when the blocks are stacked, relative lateral shifting of the blocks is minimized. Moreover, the top portion of the block has additional recesses 44 which are aligned with recesses 40 and extend between the stops 42. The additional recesses 44 surround a central stop member 46. The additional recesses 44, and the central stop member 46 allow the blocks to be stacked in a pyramid fashion.

The coupling construction gives the block a true block appearance when the blocks are stacked. Specifically, when a block is to be stacked, and its coupling member can be disposed completely in its respective slot, with its end walls 26, 28 with the side walls 12, 14 of the block. In that position (FIGS. 4 and 5) the coupling members do not project, and the blocks have a true block (i.e., cubical) contour.

Thus, according to the invention, applicants have provided what is believed to be a unique block construction, for forming blocks which can be coupled together to form a train, or stacked on top of each other.

What is claimed is:

1. Apparatus comprising a block for use in forming an assembly of blocks which can be coupled together to form a train and which can be stacked on top of one another, said block having a bottom portion with wheels which can roll in order to move the block, said block having a top portion with means for supporting the bottom portion of another block of similar construction and for minimizing relative lateral shifting of the block supported thereon so as to allow stacking of the blocks, a coupling member movably connected to said block, said coupling member being movable between a retracted position and a protracted position in which it projects partly from said block for engaging a recess in another block to join the blocks into a train, said block including a slot and said coupling member is supported for movement in said slot, said coupling member being dimensioned so as to be disposed completely in said slot when in said retracted position and to project out of one portion of said slot and create a recess in another portion of said slot for receiving a coupling member from another block when in said protracted position.

2. Apparatus as defined in claim 1 wherein the portion of said coupling member which projects out of said one portion of said slot includes locking tabs, and the recess created in the other portion of said slot includes notches for engaging the locking tabs on a coupling member projecting from another block for locking the blocks.

3. Apparatus as defined in claim 2, wherein said block includes parallel spaced apart side walls and the wheels are disposed so as to move the block in directions perpendicular to said side walls, said slot extending through the block between said side walls and in a direction perpendicular to said side walls.

4. Apparatus as defined in claim 3, wherein said coupling member has end walls which are aligned with said side walls when said coupling member is in said retracted position.

5. Apparatus as defined in claim 4, wherein said top portion includes arcuate recesses for receiving and supporting the wheels of another block and stop means facing the arcuate recesses for preventing lateral shifting of the wheels of a block supported thereon.

6. Apparatus as defined in claim 5, wherein the bottom portion of the block includes two pairs of wheels aligned with each side wall, and the top portion of the block has a pair of recesses aligned with each of the opposite side walls for engaging the wheels on another block, and said stop means including a plurality of stop members disposed adjacent to each of the corners of the block and facing both of the arcuate recesses adjacent each of the corners of the block.

7. Apparatus comprising a block for use in forming an assembly of blocks which can be coupled together to form a train and which can be stacked on top of each other, said block having a top side, a bottom side and a pair of parallel side walls disposed between said top and bottom sides, a pair of spaced apart wheels connected with the bottom side of said block for moving the block in directions perpendicular to the side walls, means on the top side of said block for engaging the bottom side of another block of similar construction in such a way as to minimize relative lateral movement of the blocks and allow stacking of the blocks, means for interconnecting the block with a similarly configured block for forming a train of blocks, said means for interconnecting the block including a coupling member attached thereto slidable in a slot formed in said block and extending between said side walls, said coupling member having a lengthwise dimension equal to the distance between the side walls so that when the coupling member is disposed completely in the slot its ends are adjacent the side walls of the block, said coupling member being slidable in either direction in said slot so that one end of the slidable member can project from one side wall of the block and the other end of the coupling member forms part of a recess at the other side wall of the block, and means carried by each end of said coupling member for engaging mating coupling means in the recess formed by another block member for coupling the blocks together.

8. Apparatus as defined in claim 7, wherein said top portion includes arcuate recesses for receiving and supporting the wheels of another block and stop means facing the arcuate recesses for preventing lateral shifting of the wheels of a block supported thereon.

9. Apparatus as defined in claim 8, wherein the bottom portion of the block includes two pairs of wheels aligned with each side wall, and the top portion of the block has a pair of recesses aligned with each of the opposite side walls for engaging the wheels on another block, and said stop means including a plurality of stop members disposed adjacent to each of the corners of the block and facing both of the arcuate recesses adjacent each of the corners of the block.

10. Apparatus as defined in any of claims 7, 8 or 9, wherein said coupling member has end walls which are aligned with said side walls when said coupling member is disposed completely in said slot.

* * * * *